United States Patent [19]

Kumm et al.

[11] 4,153,028

[45] May 8, 1979

[54] ATOMIZER

[76] Inventors: Emerson L. Kumm, 1035 E. Laguna Dr., Tempe, Ariz. 85282; Maurice J. Moriarty, 3225 W. Sahuaro Dr., Phoenix, Ariz. 85029

[21] Appl. No.: 831,076

[22] Filed: Sep. 6, 1977

[51] Int. Cl.[2] ..... F02M 29/02

[52] U.S. Cl. ..... 123/141; 261/84; 48/180 S

[58] Field of Search ..... 123/141; 261/84, 79 R; 48/180 S, 180 R, 180 M

[56] References Cited

U.S. PATENT DOCUMENTS

| | | | |
|---|---|---|---|
| 1,031,147 | 7/1912 | Plumm | 261/84 |
| 1,156,716 | 10/1915 | Shores | 123/141 |
| 1,979,747 | 11/1934 | Kenneweg | 48/180 S |
| 2,018,561 | 10/1935 | Lucich | 48/180 S |
| 2,186,829 | 1/1940 | Haddock | 261/84 |
| 2,216,722 | 10/1940 | Denson | 123/141 X |
| 3,283,482 | 11/1966 | Trafford et al. | 123/141 X |
| 4,014,306 | 3/1977 | Ingersoll | 123/141 |

FOREIGN PATENT DOCUMENTS

| | | | |
|---|---|---|---|
| 969826 | 6/1975 | Canada | 123/141 |
| 359062 | 10/1931 | United Kingdom | 123/141 |

*Primary Examiner*—Ira S. Lazarus
*Attorney, Agent, or Firm*—Don J. Flickinger

[57] ABSTRACT

A cylindrical rotor is rotatably mounted within the bore of a housing. A plurality of passages arranged in concentric annular rows extend through the rotor. Each passage is generally rectangular in cross section and is inclined with respect to the axis of the rotor. The rotor is forced to rotate in response to a gaseous stream moving through the bore and the passages. Liquid particles entrained within the gaseous stream are atomized in response to the movement of the rotor.

12 Claims, 10 Drawing Figures

ATOMIZER

This invention relates to fluid flow devices.

More particularly, the instant invention concerns a device for atomizing liquid particles entrained within a gaseous stream.

In a further aspect, the present invention concerns an atomizer especially adapted for producing a substantially homogeneous mist of fuel and air when placed in the induction system of an internal combustion engine.

In many fields of art it is common practice to produce a fluid mixture of gas and liquid. Typically, the gas is caused to move in response to a pump or other conventional device. Liquid particles are deposited into the moving gas by various well known means, such as drawing the liquid into the gas, especially by passing the gas over an orifice within a venturi, or injecting the liquid into the gas, especially by a pressure nozzle device aimed into the gas stream.

The moving stream of gaseous fluid having liquid particles entrained therein is delivered to a predetermined target to satisfy a desired purpose. The stream may be delivered in either an open system or a closed system. Exemplary of an open system is the spraying of field crops with a liquid insecticide wherein the gas and liquid mixture is broadcast into the environment of the plants. Representative of a closed system is the internal combustion engine wherein the air/liquid mixture flows through a conduit between the carburetor and the combustion chamber. Other examples include the delivery of such liquids as water, fire retardant and extinguishing chemicals and paints.

While the device of the instant invention has utility fields of art, the invention will be described herein for purposes of reference in connection with an internal combustion engine. Briefly, as is well known, the induction system of a conventional internal combustion engine basically includes a carburation device, an intake manifold, and the one or several combustion chambers.

In response to the vacuum created by the downward movement of the piston, fresh air is drawn through the carburetor. The air passes through a venturi and over an orifice which communicates with a fuel supply. Resultingly, fuel is drawn into the air stream. The fuel and air mixture passes from the carburetor through the intake manifold and the open intake valve into the combustion chamber where it is subsequently compressed, ignited by a spark plug and burned. Energy released during the burning of the fuel and air mixture generates the power for driving the piston downwardly, which movement is translated through mechanical means to useful work.

Carburetors, at best, are a rather inefficient fuel/air mixer. The relatively large size of the fuel particles, having a mean size on the order of ten microns, causes various problems. Fuel drops of this size readily separate from the mixture and form pools within the induction system, a condition that is commonly referred to as "puddling" within the art. Puddling is particularly pronounced during periods of low velocity air flow during starting and idling.

In an attempt to prevent puddling within the intake manifold, it is common practice for manufacturers to supply engines having heat riser means within the intake manifold. While partially alleviating the problem at low speeds, and low power settings, the solution has a deleterious effect upon the performance of the engine particularly at higher speeds, and higher power settings, where it is desirable to keep the fuel charge cool. Fuel settling out of the mixture within the combustion chamber is not properly burned. It is a matter of record that unburned fuel results in the discharge of hydrocarbons which are a common cause of smog. The discharge of hydrocarbons from the engine is somewhat alleviated by the addition of an air injection system to burn unburned fuel within the exhaust manifold. In addition to substantially increasing the temperature within the exhaust manifold and further complicating the engine, the air injection system causes other problems, such as a tendency for the engine to backfire.

Hydrocarbons have been fairly successfully controlled by the addition of an ignition induction system to provide what is commonly referred to as a "lean burn engine". Lean burn engines tend to be quite tempermental and suffer dramatically from a loss of power. The lean mixtures necessary to control hydrocarbons and the resulting high combustion chamber temperatures also cause an increase in nitrogen oxides ($NO_x$) emissions.

It is generally recognized that undesirable emissions can be reduced, fuel consumption decreased, and performance of the engine increased by proper mixing of the fuel and air as it enters the induction system. The art has produced carburetors which, over a substantially wide range of engine operating conditions, deliver a more proper fuel/air mixture of the engine than conventional carburetors of the type commonly in use. The more efficient carburetors have an atomization system which pre-mixes or emulsifies a predetermined amount of fuel and an auxiliary venturi located in the center of the main venturi which serves to concentrate the emulsified fuel mixture in the center of the air flow through the carburetor intake. Such carburetors are extremely sophisticated, expensive to manufacture, require frequent and exacting application of skill for proper maintenance and have never achieved widespread commercial acceptance. Neither are such carburetors generally adapted for retrofit to pre-existing engines.

Another prior art proposal is an auxilliary atomizing or vaporizing device which is generally placed between the carburetor and the intake manifold. Such devices are conveniently installed by the original equipment manufacturer or as retrofit accessories to pre-existing engines. A basic type of auxilliary atomizer simply employs a screen which is placed in the fuel/air stream. More advanced types utilize a rotor which spins in reaction to the movement of the fuel mixture stream. Generally the rotors are of two basic configurations, a propeller or a plate with a plurality of holes therethrough.

In general, the propeller type gives better mixing of the fuel and air, while the plate with hole type yields smaller fuel particle size. An effectively designed rotor of the latter type is capable of reducing the fuel particle size to the order of five microns. Each type seriously restricts the flow, causing a low pressure area within the induction system. Fuel drops not thoroughly mixed or atomized will quickly drop out in the low pressure area, causing puddling as hereinbefore noted. Further, a significant portion of the fuel which contacts the rotor is thrown centrifugally against the surrounding walls rather than being entrained within the air stream. Other problems associated with rotor type fuel/air mixers include limited life of the bearing upon which the rotor is mounted, restricted operational range of the engine and generally poor flow geometry characteristics.

It would be highly advantageous therefore to remedy the deficiencies associated with the prior art in improving the efficiency of the fuel/air mixture.

Accordingly, it is an object of the instant invention to provide an improved atomizer for reducing the size of liquid particles within a gaseous fluid stream.

Another object of the invention is the provision of an atomizer which will mix the liquid and gas into a substantially homogeneous fog.

And, another object of the invention is to provide an atomizer which is adapted for use in various fields of art including internal combustion engines.

Still another object of the invention is the provision of an atomizer which will not substantially reduce the flow therethrough.

Yet another object of the present invention is to provide an atomizer that is so constructed to prevent liquid from being deposited upon walls and surfaces of surrounding structure.

Yet still another object of the invention is the provision of an atomizer which when used in combination with an internal combustion engine will assist in thermal isolation of the carburetor.

A further objet of the invention is to provide an atomizer which will eliminate puddling within the induction system.

And a further object of the invention is the provision of an atomizer which will increase fuel economy and reduce undesirable emissions.

Still a further object of the instant invention is to provide an atomizer which by virtue of providing a more thoroughly combustible mixture will permit the use of leaner mixtures without the normally associated difficulties.

Yet a further object of the instant invention is to provide an atomizer which is operative over a wide range of engine operating conditions.

And a still further object of the invention is the provision of an atomizer which will reduce the need for auxiliary structural complications, such as heat risers.

An even further object of the invention is to provide means for improving the response characteristics of an internal combustion engine.

Still even another object of the invention is the provision of an atomizer which will improve cold starting characteristics of an internal combustion engine.

And yet a further object of the invention is to provide an atomizer of the above type which is durably constructed, reliably operative and relatively maintenance free.

Briefly, to achieve the desired objectives of the instant invention in accordance with the preferred embodiment thereof, first provided is a housing having a generally cylindrical bore extending therethrough. The housing is adapted to be placed, as between the carburetor and the intake manifold of internal combustion engines, such that a stream of gaseous fluid having liquid particles entrained therein, passes through the bore. A support member carried by the housing and extending transversely across the bore rotatably supports a cylindrical rotor within the bore. The rotor is rotatable about an axis generally parallel with the movement of the stream. A plurality of passages extend through the rotor and are inclined with respect to a plane radial to the axis of the rotor to urge rotation of the rotor in response to movement of the stream through the passages.

Preferably, the passages are rectangular in cross-section and are arranged in concentric annular rows. In a further embodiment, a first circumferential lip is upstanding from the upstream side of the rotor, and a second circumferential lip depends from the downstream side of the rotor. The bore of the housing is generally barrel shaped in cross-section, being smaller at the inlet and the outlet than the diameter of the rotor.

The foregoing and further and more specific objects and advantages of the present invention will become readily apparent to those skilled in the art from the following detailed description of a preferred embodiment thereof taken in conjunction with the drawings, in which.

Figure 1:
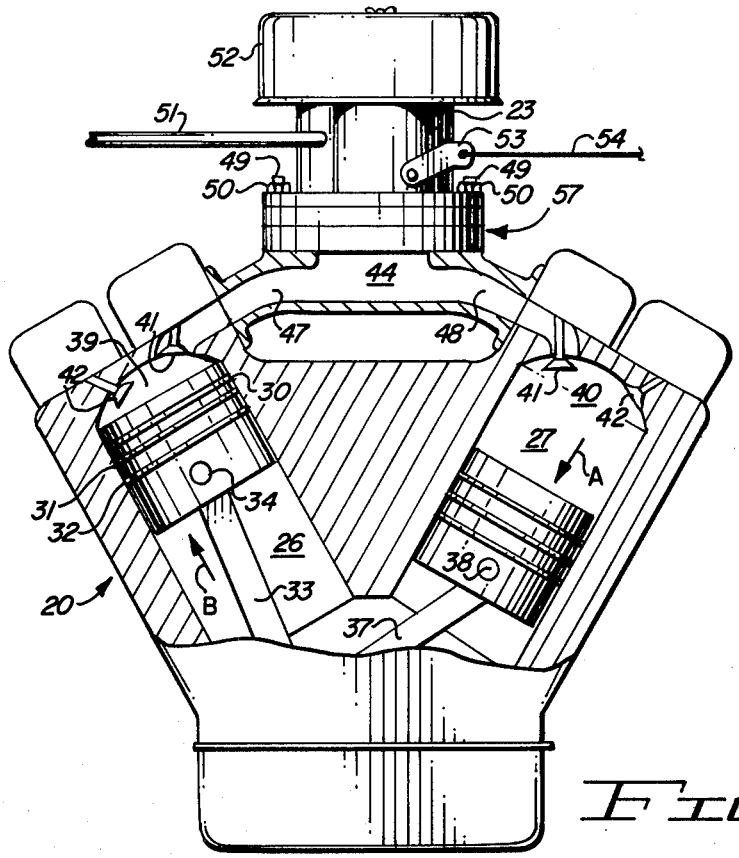
FIG. 1 is a semi-schematic representation of a conventional internal combustion engine, partly in vertical section, having an atomizer, constructed in accordance with the teachings of the present invention, associated therewith.

Turning now to the drawings, in which the same reference numerals indicate corresponding elements throughout the several views, attention is first directed to FIG. 1, which schematically illustrates a typical internal combustion engine, generally designated by the reference character 20 of conventional V-type design. Such engines are well known in the art and need not be described in detail herein. Briefly, however, of immediate interest for the ensuing discussion, it is significant that engine 20 includes engine block 21 and intake manifold 22 and a carburetor 23. Intake manifold 22, carburetor 23 and associated operative components are commonly referred to as the induction system.

Angularly disposed within block 20 are cylindrical bores 26 and 27, commonly referred to in the art as cylinders. In accordance with conventional practice, V-type engines are fabricated with varying numbers of pairs of cylinders. Pistons 28 and 29 are slideably disposed within respective bores 26 and 27. Each piston is sealingly engaged with the walls of the respective cylinder by first and second compression ring seals 30 and 31 and oil ring seal 32. It is noted that the pistons do not touch the cylinders and are held in spaced relationship by the various ring seals. The upper end of connecting rod 33 is pivotally attached to piston 28 by wrist pin 34. Similarly, connecting rod 37 is affixed to piston 29 by wrist pin 38. Although not specifically herein illustrated, it will be readily understood by those skilled in the art that the lower ends of connecting rods 33 and 37 are rotatably journaled to a crank shaft which provides the power output takeoff for the engine and through suitable transmission and gearing arrangements is made to drive a vehicle or perform other useful work.

The upper portions 39 and 40 of cylinders 26 and 27, respectively, are considered the combustion chambers, each including intake valves 41 and exhaust valves 42. Valves 41 and 42 are made to open and close in timed relationship to the movement of the associated pistons by an assemblage known as the valve train which is driven by a cam shaft rotating in timed relationship with the crank shaft.

Intake manifold 22 includes a carburetor mounting pad 43, plenum 44 and a plurality of conduits, such as shown at 47 and 48, which communicate with the combustion chambers of the several cylinders through intake valves 41. Carburetor 23 is secured to carburetor mounting pad 43 by virtue of studs 49 which are upstanding from carburetor mounting pad 43 and nuts 50. Fuel is fed to carburetor 23, such as by a fuel pump or other pressurized source, through fuel line 51. Air is drawn into carburetor 23 through air cleaner 52. The speed and power output of the engine is controlled by throttle means within carburetor 23. The operator of the engine is provided with remote control of the throttle means through a system of throttle linkage, such as includes lever 53 and cable 54.

At the instant of operation of engine 20, as seen in FIG. 1, piston 29 is assumed to be in the intake cycle moving in the direction of arrow A. Intake valve 41 associated therewith is open and exhaust valve 42 is closed. In response to the downward movement of piston 29, a low pressure area or partial vacuum is created in combustion chamber 40 and, in response thereto, air is drawn through air cleaner 52, where it is mixed with fuel in carburetor 23. The fuel/air mixture passed into plenum 44 and is delivered through conduit 48 and intake valve 41 and combustion chamber 40. Subsequently, intake valve 41 closes and piston 29 moves upward, compressing the fuel/air mixture which is then ignited, driving piston 29 downwardly through the power stroke. Concurrently, piston 28, having completed the power stroke, is moving upwardly in the direction of arrow B, discharging the burned and partially burned mixture into an exhaust system through open exhaust valve.

The foregoing description of engine 20 has been set forth briefly, omitting substantial detail. Those skilled in the art will have appreciation and understanding of the description and the further complexities thereof, not herein specifically stated, but necessary for the operation thereof. The description has been included herein as an environmental setting for the atomizer of the instant invention.

Figure 2:
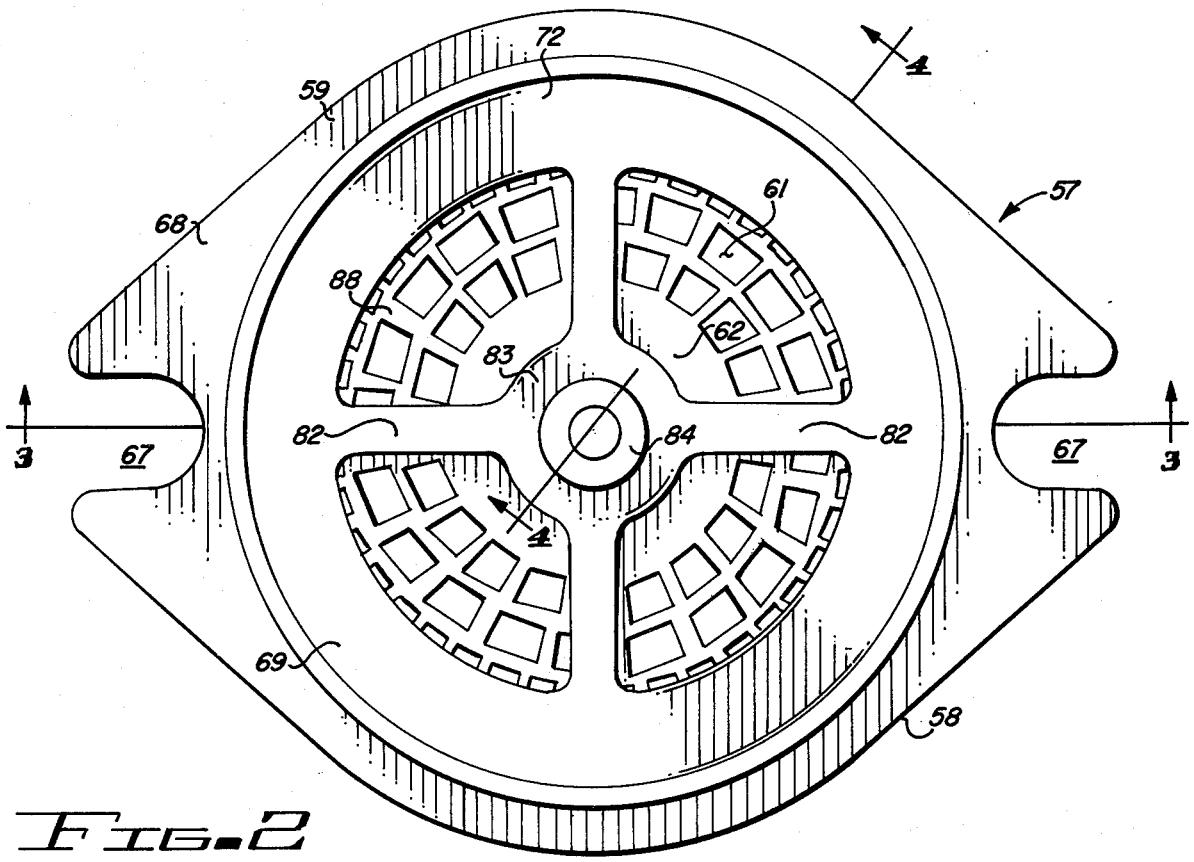
FIG. 2 is a plan view of an atomizer of the instant invention.
Figure 8:
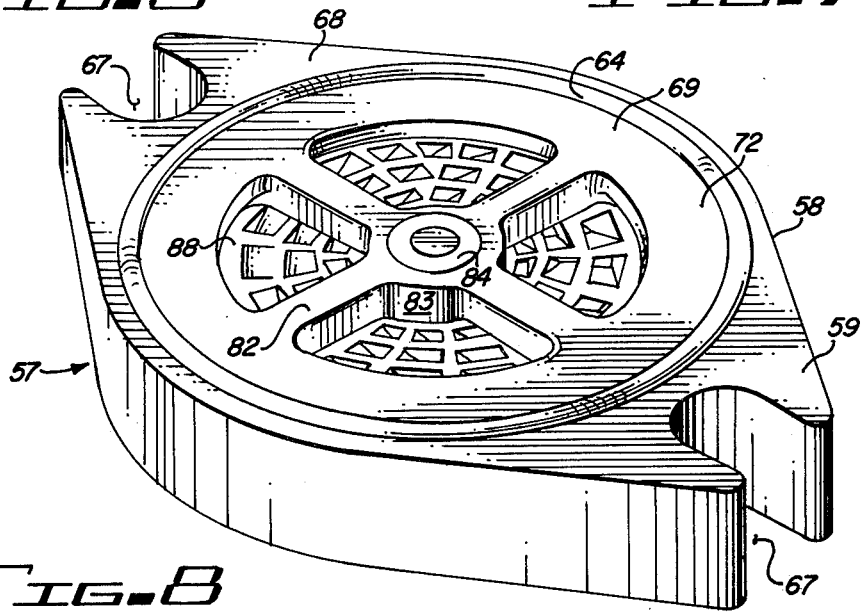
FIG. 8 is a perspective view of the rotor of FIG. 2.

An atomizer, constructed in accordance with the teachings of the present invention and generally designated by the reference character 57, is positioned between carburetor mounting pad 43 of intake manifold 22 and carburetor 23. Atomizer 57, as further seen in FIGS. 2, 3 and 8, includes a housing 58 having spaced apart first and second surfaces 59 and 60, respectively. Cylindrical bore 61 extends through housing 58, terminating with inlet 62 at first surface 59 and outlet 63 at second surface 60.

Second surface 60 is received upon carburetor mounting pad 43 and carburetor 23 rests upon second surface 60. A flat gasket is normally used between carburetor 23 and carburetor mounting pad 43. Preferably during installation of device of the instant invention, the flat gasket is retained between carburetor mounting pad 43 and second surface 60. An O-ring seal 64, which will be described hereinafter in further detail, is carried in first surface 59 for contact with carburetor 23. The retention of the originally flat gasket and O-ring seal 64 is to prevent air leakage into the induction system, the necessity of which is readily understood by those skilled in the art. Diametrically opposed slots 67 accommodate studs 49. In accordance with the immediate embodiment, inlet 62 and outlet 63 have a common diameter which is approximately equal to the throttle bore through carburetor 23. Since the stream of fuel/air mixture moves downwardly from carburetor 23 into intake manifold 22, first surface 59 and second surface 60, for purposes of reference, can be considered as the upstream and downstream sides, respectively, of housing 58.

To facilitate manufacturing, housing 58 is fabricated in two sections, a base 68 and a rotor support 69. Base 68 has a cylindrical bore 70 extending from first support 59 and terminating with annular shoulder 71. Rotor support 69 includes an annular portion 72, having a first surface 73 and a second surface 74, with outer cylindrical surface 77 extending therebetween. Outer cylindrical surface 77 is sized to be received, in press-fit engagement, within bore 70. With second surface 74 in contact with annular shoulder 71, first surface 73 lies in the plane of first surface 59 of housing 58. A step removed at the juncture of first surface 73 and outer cylindrical surface 77 forms, in conjunction with bore 70 of base 68, a suitable groove 78 for O-ring seal 64. Preferably, base 68 and rotor support 69 are molded of a thermally insulative plastic, such as certain compression molded phenolics, as is well known in the plastics art. Such compression molded materials resist the transfer of heat from intake manifold 22 to carburetor 23.

In general, bore 61 is barrel shaped, being larger in the mid-section than at either end. A preferred configuration of bore 61 is best described in connection with FIG. 4. Starting at inlet 62, bore 61 diverges as defined by arcuate surface 79, which blends tangentially with reverse arcuate surface 80. Arcuate surface 80 terminates at the junction of annular shoulder 71 and second surface 74. From the termination of arcuate surface 80, bore 61 converges toward outlet 63 along frusto-conical surface 81.

Formed integrally with rotor support 69 are struts 82, which extend radially inward from annular portion 72, which support integral hub 83. Insert 84, having internally threaded bore 87 extending therethrough and preferably fabricated of a corrosion resistant metal, is carried within hub 83. Insert 84 may be molded in place, pressed in place or assembled with hub 83 in other ways well known in the art. Insert 84 has a longitudinal axis indicated by the broken line C which is concurrent with the longitudinal axis of bore 61 and parallel to the normal direction of movement of the fuel/air mixture. The longitudinal axis represented by the broken line C is also the axis of rotation of rotor 88, as will now be described.

Rotor 88 is a relatively thin, generally cylindrical member having upstream side 89, downstream side 90 and circumferential surface 91. Central bore 92 extends through rotor 88 and is axially aligned, with the axis represented by broken line C. Bearing 93 is fitted into bore 92. While various friction and anti-friction bearings suitable for the immediate purpose will occur to those skilled in the art, satisfactory results have been achieved with a ball-type bearing, as more clearly illustrated in FIG. 9. Ball-type bearing 93 includes outer race 96, inner race 97 and a plurality of balls 98 therebetween. Circumferential flange 99 extends radially from outer race 96 and abuts the downstream side 90 of rotor 88. Seals 100, carried by outer race 96 and sealingly engaging inner race 97, are disposed on either side of balls 98. The balls 98 are thus encapsulated in a closed space. Balls 98 are permanently lubricated, preferably using a silicon based oil or grease retained by seals 100. The silicon based oils or greases now available give excellent lubrication and are resistant to the solvent action of gasoline and other hydrocarbon fuels. The location of bearing 93 immediately downstream and shielded by hub 83 further prevents any liquid fuel from normally contacting the bearing.

Shoulder bolt 101, herein specifically illustrated as the Allen head type, having head 102, cylindrical shank 103 with shoulder 104 therebetween, and threaded shank 107 terminating with shoulder 108, extends through bearing 93 and is threadedly engaged with insert 84. Shoulder bolts and the use thereof are well known in the art.

Figure 5:
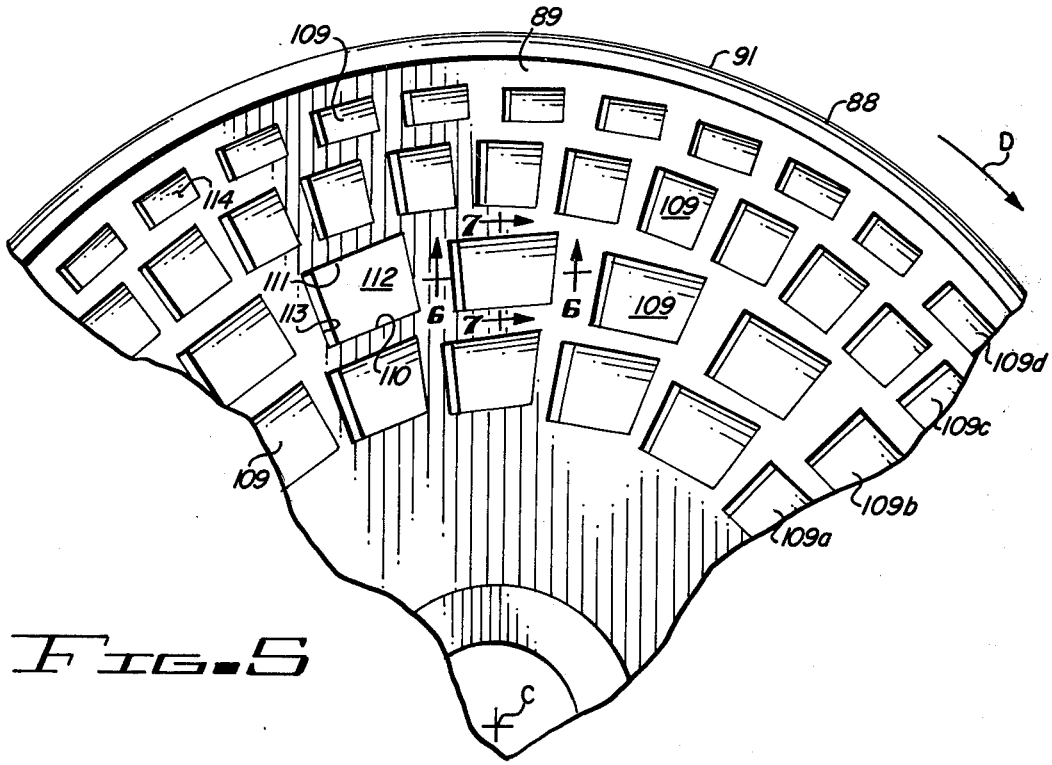
FIG. 5 is a fragmentary plan view of a rotor used in the atomizer of the instant invention.
Figure 9:
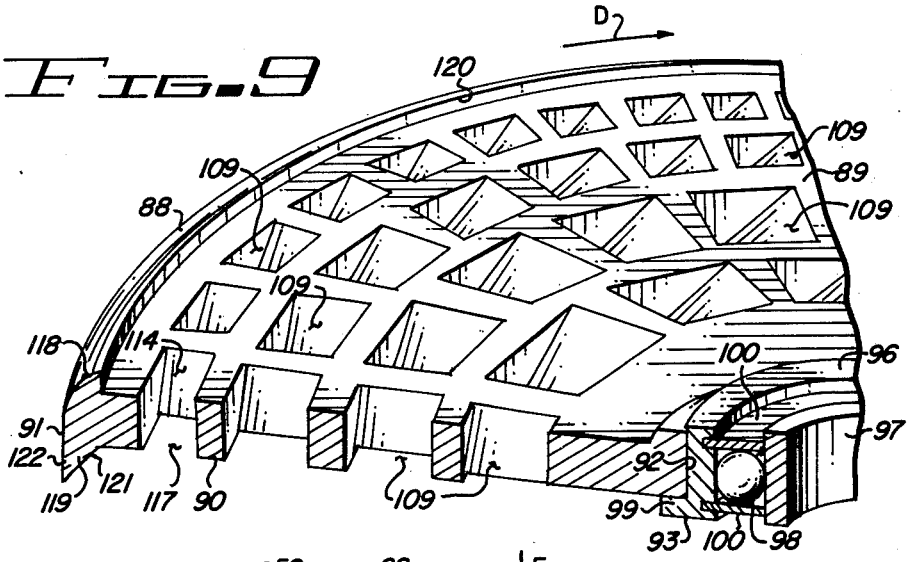
FIG. 9 is a fragmentary perspective view of the rotor of FIG. 5.

Attention is now directed more specifically to FIGS. 5 and 9, which further illustrate rotor 88, which is preferably fabricated by molding a synthetic material such as nylon. A plurality of passes, which are further illustrated in FIGS. 6 and 7, extend through rotor 88. Passages 109 are arranged in concentric annular rows, which, starting closest to axis C, are designated **109*a*, 109*b*, 109*c* and 109*d*. Each passage is generally rectangular in cross-section, having a first pair of opposed walls, including inner wall 110 and outer wall 111, and having a second pair of opposed walls, including a leading wall 112 and a trailing wall 113. Inner wall 110 and outer wall 111 are located for reference purposes in relation to the respective radial distance from axis C. Leading wall 112 and trailing wall 113 are referenced in respect to the direction of rotation of rotor 88, as denoted by arrow D. The cause for rotation of rotor 88** in the direction of arrow D will be explained presently.

Each passage 109 has an inlet 114 opening on the upstream side 89 of rotor 88 and an outlet 117 opening on the downstream side 90 of rotor 88. Various configurations of passages and placement of passages will occur to those skilled in the art. A preferred pattern, in accordance with the teachings of the present invention, is best described with reference to FIG. 5. The description will be made with reference to the configuration of each inlet 114, as defined by the juncture between each of the several sides 110, 111, 112 and 113, and the surface of upstream side 90.

As seen, each passage **109*d*, lying in the fourth or outermost row, is generally rectangular, having a length of approximately twice the width. That is, the distance measured along sides 110 and 111 in the plane of upstream side 89 is approximately twice the length of sides 112 and 113 measured in the same plane. The edges of sides 112 and 113 lie along lines radial to axis C. The edges of sides 110 and 111 in the plane of upstream side 89 are perpendicular to a radial line bisecting the radial lines along the edges of sides 112 and 113. Measured annularly, each passage 109*d* is approximately six degrees long, with a spacing of approximately three degrees between passages 109*d***.

The number of passages **109*c* equals the number of passages 109*d*. The dimensional configuration of passages 109*d* is applicable to the passages 109*c*, with the exception that measured radially passages 109*c* are approximately twice the width of passages 109*d*. It is also noted that each passage 109*c* is offset relative each passage 109*d*** in a direction counter to arrow D by approximately three degrees.

The number of passages **109*b* in the second row and the number of passages 109*a* in the first row are equal. The number of either passages 109*a* or 109*b* is equal to one-half the number of either passages 109*c* or 109*d*. Each passage 109*a* and 109*b* is bounded by radial lines, along the inlet edges of walls 112 and 113, that are approximately twelve degrees apart. Measured radially, each passage 109*a* and 109*b* is approximately twice the width of each passage 109*d*. Each passage 109*a* is offset relative each passage 109*b*** by three degrees in a direction counter to arrow D.

Figure 6:
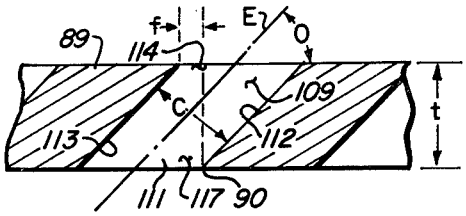
FIG. 6 is a vertical, sectional view, taken along the line 6—6 of FIG. 5.
Figure 7:
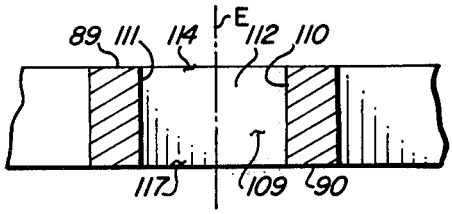
FIG. 7 is a vertical, sectional view, taken along the line 7—7 of FIG. 5.

The path of each passage 109 through rotor 88 is best described with reference to an imaginary longitudinal axis E, as illustrated in FIGS. 6 and 7. Axis E, as viewed in a first direction, as set forth in FIG. 7, lies in a plane which is generally tangential to any radius extending from axis C and is rotatable about axis C. Axis E is also seen as parallel to axis C. As viewed in a second direction, as shown in FIG. 6, axis E lies in a plane parallel to axis C, but is inclined relative axis C, and is rotatable about axis C.

The inclination of axis E relative axis C, herein designated by the common Greek reference symbol $\theta$, is given by the following equations:

$$\tan \theta = t/f$$

$$\sin \theta = c/f$$

In the foregoing equations, the symbol t is the thickness of the rotor or the distance between upstream side 89 and downstream side 90, as measured parallel to axis C. The symbol c represents the tangential width of the passage, as measured normal to axis E. The symbol f is the tangential width of the inlet measured in the plane of upstream side 89. Typically, it is preferred that the rotor has a thickness or approximately 0.100 inches to 0.150 inches.

The number of passages within a rotor is variable, dependent upon various factors, such as the diameter of the rotor. It is desirable that as many passages as possible be placed in a given rotor. Or, stated in other terms, it is desirable that as much of the rotor as possible be passages, as opposed to surface area or web therebetween. An integral even number of passages must be employed to obtain a uniform spacing for the outer two rows of passages, **109*d*, 109*c*, in order that one number of passages be an integral number of passages for the inner two rows, 109*a*, 109*b***. An optimum number of passages can be calculated from the following formula:

$$N = 2\pi r / N(f + w)$$

In the foregoing formula, r is the radial dimension of the given rotor. The symbol w is the web thickness, or distance between adjacent passages consistent with the strength of the material chosen for the rotor.

The prior art teaches that the passages within a rotor are cylindrical in cross-section. This has seriously limited the cross-sectional flow area of prior art devices and has resulted in a substantial flow pressure drop through the device. Utilizing the foregoing formulas, as taught by the instant invention, greatly increases the flow cross-sectional area and significantly reduces the pressure drop. Typically, for the same web thickness between passages, the flow cross-sectional area, as taught by the instant invention, is increased by a factor of 1.414, or the ratio of the area of a square to the area of a circle having a diameter of length equal to the side of the square.

Figure 3:
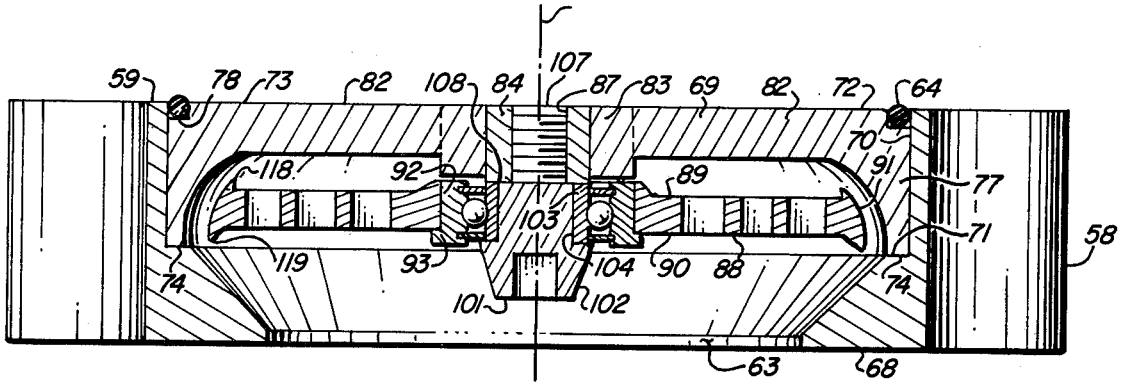
FIG. 3 is a vertical, sectional view, taken along the line 3—3 of FIG. 2.
Figure 4:
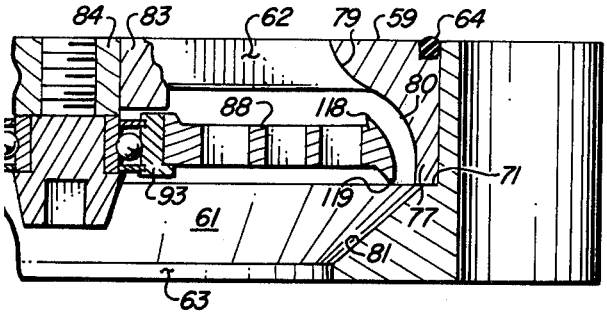
FIG. 4 is a vertical, sectional view, taken along the line 4—4 of FIG. 2.

As seen throughout the several views, especially FIGS. 3, 4 and 9, a first circumferential lip 118 extends upwardly from upstream side 89 and a second circumferential lip 119 depends from downstream side 90 of rotor 88. Inner surface 120 of first lip 118 is substantially perpendicular to upstream surface 89. Inner surface 121 of second circumferential lip 119 is substantially frustoconical and diverges downwardly. Circumferential edge 122 of rotor 88 has a surface that is spaced from and approximates the adjacent surface of bore 61.

Figure 10:
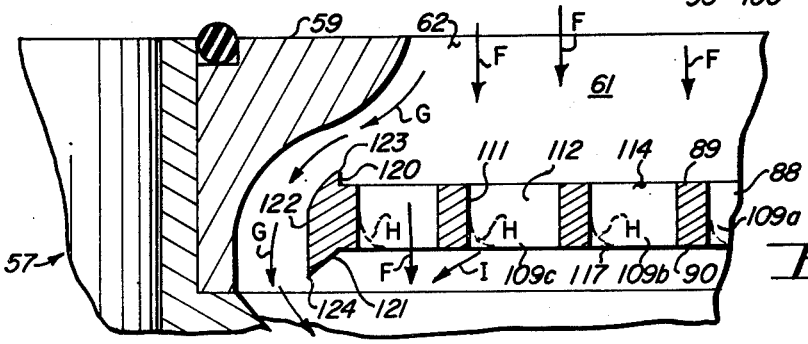
FIG. 10 is a fragmentary vertical, sectional view of the atomizer of the instant invention taken along the longitudinal axis thereof and schematically illustrating the flow of the gaseous stream therethrough.

The function and operation of an atomizer constructed in accordance with the teachings of the present invention will now be described in connection with FIG. 10. The fuel/air mixture provided by the carburetor enters bore 61 through inlet 62, moving in the direction of arrows F, which are substantially parallel to axis C, as drawn by the vacuum created by alternate pistons within the engine. A circumferential component of the moving stream, as indicated by arrows G closely follows the contoured surface of bore 61, passing around circumferential surface 122 and avoiding rotor 88. Other components of the stream enter respective passages 109 as are aligned with the component. The force of the stream against the several inclined walls 112 urges rotation of rotor 88 in the direction of arrow D as previously noted. Small fuel particles, entrained within the gaseous fluid stream, and thoroughly mixed and atomized, are carried through the passages by the stream. Larger fuel particles settle out along wall 112. Concurrently, the larger fuel particles are driven downwardly by the moving stream and centrifugally are flung radially outward toward wall 111. This tends to form a pooling of the liquid adjacent outlet 117 at the juncture of walls 111 and 112, as indicated by the dashed lines H.

The pooled fluid, in each area H, is continuously discharged through outlet 117, which is projected radially outward, as represented by the arrow I. The passages are so arranged that each component of fuel I collides with the discharge air jet H from a radially outward passage. The collision effectively atomizes the fuel.

Fuel leaving passage **109*d* strikes against second circumferential lip 119 and is atomized in the stream represented by arrows G. Rotor 88 is larger than inlet opening 62. Large droplets of fuel, especially those settling out against the walls of the carburetor, and settling upon upstream surface 89, are propelled radially against first circumferential lip 118. As the larger droplets pool in the area of the juncture of upstream surface 89 and inner surface 120, a portion thereof passes through passages 109*d*. The other portion is propelled over the top of first circumferential lip 118, colliding and atomizing the air stream G. It is noted that first circumferential lip 118 and second circumferential lip 119 terminate with sharp edges 123 and 124, respectively. The sharp edges 123 and 124** assist in distributing a thin layer of liquid.

Thus, it is seen that the fuel/air flow, represented by arrows F, acts to propel rotor 88 to a high rotational speed, variable with the velocity and pressure of flow, to thoroughly atomize liquid fuel contacting rotor surface 89. It will also be appreciated that the jets of air and fuel from passages 109 have considerable swirl below the downstream side of rotor 88, producing a substantially homogeneous gaseous liquid fog. The fog provides a uniform fuel/air mixture important for operation of multi-cylinder engines and not heretofore achieved by the prior art. The degree of atomization is exceedingly fine, in the range of approximately three microns, so that the mixture is more readily ignited during starting.

It will be readily appreciated by those skilled in the art that the fuel fog droplets, as a result of atomization, are so minute that they are carried through the intake manifold without pooling. Heat risers, therefore, are not necessary to obtain fuel vaporization within the intake manifold. Further, since the fog is readily combustible, fuel deposits upon cylinder walls are substantially eliminated, especially the fuel which is commonly deposited between the piston and the cylinder wall. Complete combustion within the cylinder alleviates the necessity of further burning the unburned and partially burned fuels within the exhaust manifold. Therefore, it is immediately apparent that undesirable emissions are substantially reduced. Also, since all of the fuel entering the cylinder is available for combustion, the engine can be run on a somewhat leaner mixture, resulting in greater economy of operation.

Having fully described and disclosed the present invention and the preferred embodiment thereof in such clear and concise terms as to enable those skilled in the art to understand and practice the same, the invention claimed is:

1. An atomizer for placement in a moving stream of gaseous fluid having liquid particles entrained therein and for atomizing said particles to produce a substantially homogeneous gaseous-liquid fog, said atomizer comprising:

(a) a plastic housing having first and second spaced surfaces and having a generally cylindrical bore extending between said surfaces,
 said bore having an inlet at said first surface and having an outlet at said second surface and receiving said stream therethrough in a direction from said first surface;

(b) a support member carried by said housing and extending transversely across said cylindrical bore;

(c) a generally cylindrical rotor having an upstream side and a downstream side and carried by said support member within said cylindrical bore and rotatable about an axis generally parallel with the movement of said stream; and (d) a plurality of passages extending through said rotor, each said passage including an inlet on the upstream side of said rotor and an outlet on the downstream side of said rotor, and each said passage being inclined with respect to a plane radial to the axis of said rotor to urge rotation of said rotor in response to movement of said stream through said passages, each said passage including:
 (i) a first pair of opposed walls, including an inner wall and an outer wall spaced radially from the axis of said rotor, and
 (ii) a second pair of opposed walls, including a leading wall and a trailing wall spaced annularly with respect to the axis of said rotor and extending between said first walls.

2. The atomizer of claim 1, wherein the longitudinal axis of each said passage lies in a first plane which is generally tangential to any radius extending from the axis of said rotor and is inclined within a second plane parallel to the axis of said rotor.

3. The atomizer of claim 2, wherein each said wall generally lies in a plane parallel to the longitudinal axis of said passage.

4. The atomizer of claim 3, wherein each said wall is generally planer and meets each adjacent wall at an approximate right angle.

5. The atomizer of claim 1, further including a first circumferential lip upstanding from the upstream side of said rotor.

6. The atomizer of claim 1, further including a second circumferential lip depending from the downstream side of said rotor.

7. The atomizer of claim 6, wherein said second circumferential lip includes a frusto-conical inner surface which diverges away from said rotor.

8. The atomizer of claim 1, wherein said bore converges upstream from said rotor toward the inlet and converges downstream from said rotor toward the outlet.

9. The atomizer of claim 8, wherein the inlet and the outlet of said bore are diametrically smaller than said rotor.

10. The atomizer of claim 1, wherein said passages are arranged in concentric annular rows.

11. The atomizer of claim 2, wherein the angle of inclination of the longitudinal axis of each said passage relative said second plane is determined by the formula:

$$\sin \theta = c/f$$

said $\theta$ being said angle of inclination, and said f being the width of the inlet of said passage as measured generally at a right angle to a radial line and in the plane of the upstream side of said rotor, and said c being the width of said passage as measured generally at a right angle to a radial line and normal to said longitudinal axis.

12. The atomizer of claim 10, wherein at least a portion of the outer wall extending from said leading wall of a passage in one of said annular rows is radially aligned with an outlet of a passage in the next adjacent outer one of said annular rows.

* * * * *